US006548789B1

(12) United States Patent
Rock et al.

(10) Patent No.: US 6,548,789 B1
(45) Date of Patent: Apr. 15, 2003

(54) ELECTRIC RESISTANCE HEATING/ WARMING FABRIC ARTICLES

(75) Inventors: Moshe Rock, Andover, MA (US); Vikram Sharma, Stoneham, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 09/592,235

(22) Filed: Jun. 12, 2000

Related U.S. Application Data

(63) Continuation-in-part of application No. 09/298,722, filed on Apr. 23, 1999, and a continuation-in-part of application No. 09/296,375, filed on Apr. 22, 1999.

(51) Int. Cl.[7] ..... H05B 3/54

(52) U.S. Cl. ..... 219/545; 219/211; 219/212; 219/528; 219/529; 219/549; 392/432

(58) Field of Search ..... 219/211, 212, 219/213, 217, 527, 528, 529, 542, 543, 544, 545, 549; 392/432, 435; 428/367

(56) References Cited

U.S. PATENT DOCUMENTS

| | | | | |
|---|---|---|---|---|
| 975,359 | A | | 11/1910 | Hefter |
| 1,553,461 | A | | 9/1925 | Negromanti |
| 1,744,327 | A | | 1/1930 | Moore |
| 1,965,542 | A | | 7/1934 | Colvin, Jr. |
| 2,025,586 | A | | 12/1935 | Hall |
| 2,203,918 | A | | 6/1940 | Moberg |
| 2,381,218 | A | | 8/1945 | Jacob ..... 139/391 |
| 2,392,470 | A | | 1/1946 | Fitzmaurice |
| 2,432,785 | A | | 12/1947 | Moberg ..... 219/46 |
| 2,458,801 | A | | 1/1949 | Schwartz |
| 2,581,212 | A | | 1/1952 | Spooner, Jr. et al. ..... 219/46 |
| 2,670,620 | A | | 3/1954 | Goldstaub |
| 2,862,097 | A | | 11/1958 | Negromanti ..... 219/46 |
| 2,945,115 | A | | 7/1960 | Weitzel |
| 3,425,020 | A | | 1/1969 | Toyooka et al. ..... 338/208 |
| 3,472,289 | A | | 10/1969 | Webber et al. |
| 3,478,422 | A | | 11/1969 | Inui ..... 29/611 |
| 3,513,297 | A | | 5/1970 | Jordan ..... 219/545 |
| 3,528,874 | A | | 9/1970 | Spencer |
| 3,721,799 | A | | 3/1973 | Carlstrom |
| 3,859,506 | A | | 1/1975 | Weckstein |
| 4,021,640 | A | * | 5/1977 | Gross et al. ..... 219/211 |
| 4,063,069 | A | | 12/1977 | Peeri ..... 219/545 |
| 4,245,149 | A | * | 1/1981 | Fairlie ..... 219/528 |
| 4,250,397 | A | | 2/1981 | Gray et al. |
| 4,375,009 | A | | 2/1983 | Fearnside et al. |
| 4,398,462 | A | | 8/1983 | Okano |
| 4,459,461 | A | | 7/1984 | Spencer |
| 4,481,881 | A | | 11/1984 | Okano |
| 4,523,086 | A | | 6/1985 | Eilentropp |
| 4,533,821 | A | * | 8/1985 | Sato ..... 219/545 |
| 4,538,054 | A | | 8/1985 | De la Bretoniere |
| 4,564,745 | A | | 1/1986 | Deschenes |
| 4,577,094 | A | | 3/1986 | Mills |

(List continued on next page.)

FOREIGN PATENT DOCUMENTS

| | | |
|---|---|---|
| DE | 2 251 207 | 5/1974 |
| DE | 299 01 225 | 5/1999 |
| EP | 0 548 574 A2 | 6/1993 |
| FR | 2 740 935 | 5/1997 |

*Primary Examiner*—Teresa Walberg
*Assistant Examiner*—Fadi H. Dahbour
(74) *Attorney, Agent, or Firm*—Fish & Richardson, P.C.

(57) ABSTRACT

Electric resistance heating/warming composite fabric articles have a fabric layer having a first surface and an opposite, second surface, and an electric resistance heating/warming element in the form of a conductive yarn mounted upon first surface of the fabric layer, e.g. in embroidery stitching, and adapted to generate heating/warming when connected to a power source. A barrier layer may be positioned, for example, at least adjacent to the first or second surface of the fabric layer. Methods of forming electric resistance heating/warming composite fabric articles are also described.

37 Claims, 6 Drawing Sheets

U.S. PATENT DOCUMENTS

| | | | | | |
|---|---|---|---|---|---|
| 4,607,154 | A | | 8/1986 | Mills | |
| 4,656,334 | A | | 4/1987 | Endo et al. | |
| 4,713,531 | A | * | 12/1987 | Fennekels et al. | 219/545 |
| 4,736,088 | A | * | 4/1988 | Bart | 219/211 |
| 4,792,662 | A | | 12/1988 | Kitagaki et al. | |
| 4,983,814 | A | | 1/1991 | Ohgushi et al. | 219/545 |
| 5,073,688 | A | | 12/1991 | McCormack | |
| 5,081,341 | A | | 1/1992 | Rowe | |
| 5,298,722 | A | * | 3/1994 | Tanaka | 219/545 |
| 5,319,950 | A | | 6/1994 | Whitt et al. | |
| 5,321,960 | A | | 6/1994 | Whitt et al. | |
| 5,364,678 | A | | 11/1994 | Lumb et al. | 428/96 |
| 5,412,181 | A | | 5/1995 | Giamati | |
| 5,422,462 | A | * | 6/1995 | Kishimoto | 219/545 |
| 5,484,983 | A | | 1/1996 | Roell | 219/545 |
| 5,573,687 | A | * | 11/1996 | Tanaka | 219/213 |
| 5,582,757 | A | | 12/1996 | Kio et al. | |
| 5,679,277 | A | * | 10/1997 | Niibe et al. | 219/543 |
| 5,858,530 | A | * | 1/1999 | McCullough, Jr. | 428/367 |
| 5,918,319 | A | | 7/1999 | Baxter | |
| 5,977,517 | A | * | 11/1999 | Grosjean | 219/211 |
| 6,160,246 | A | | 12/2000 | Rock et al. | |

* cited by examiner

ELECTRIC RESISTANCE HEATING/ WARMING FABRIC ARTICLES

TECHNICAL FIELD

This application is a continuation-in-part of U.S. application Ser. No. 09/296,375, filed Apr. 22, 1999, now pending, and a continuation-in-part of U.S. application Ser. No. 09/298,722, filed Apr. 23, 1999, now allowed. The entire disclosures of these applications are incorporated herein by reference.

This invention relates to electric fabric articles for heating/warming.

BACKGROUND

Techniques known for augmenting heating/warming capabilities of clothing fabric include adding electric wires to the fabric, typically by incorporating the wires directly into the fabric or by attaching the wires to the fabric, e.g., by sewing. It is also known, e.g., from Gross et al. U.S. Pat. No. 4,021,640, to print an electrical circuit with a resistance-heating element on a sheet of plastic, such as MYLAR®, and to incorporate strips of the plastic sheet into a fabric article, such as a glove.

SUMMARY

According to one aspect of the invention, an electric resistance heating/warming composite fabric article comprises at least: a fabric layer having a first surface and an opposite, second surface, and a flexible electric resistance heating/warming element in the form of an electricity-conducting yarn mounted upon the first surface of the fabric layer and adapted to generate heating/warming when connected in an electrical circuit with a power source.

Preferred embodiments of the invention may include one or more of the following additional features. The electric resistance heating/warming element has the form of the electricity-conducting yarn mounted upon the first surface by embroidery stitching upon the first surface. The electric resistance heating/warming element is mounted upon the first surface by securement of the conductive yarn upon the first surface, by adhesion of the conductive yarn upon the first surface, or by mechanical securement of the conductive yarn upon the first surface. The first surface is a flat surface, and the electric resistance heating/warming element is mounted upon the first surface by an overlaying protective layer laminated upon the first surface with the electricity-conducting yarn disposed and secured between the protective layer and the first surface. Preferably, the protective layer comprises plastic film. More preferably, the plastic film is breathable and permeable to moisture vapor, but resistant to passage of air and water droplets. The protective layer comprises fabric. The fabric article is flat with opposite smooth surfaces, or it has a raised surface and an opposite, smooth surface, or it has opposite, raised surfaces. The first surface is a smooth surface laminated with a barrier layer resistant to passage of air and water droplets but permeable to moisture vapor. The first surface is an inner surface or an outer surface, relative to a region to be heated/warmed. The fabric layer is hydrophobic or hydrophilic. The electric heating/warming element has resistivity in the range of about 0.1 ohm/m to 500 ohm/m. The electrical conductor elements are adapted for connecting the electric resistance heating/warming elements to a power source of alternating current or to a power source of direct current, e.g. a battery, which may be mounted to the fabric body. The electric resistance heating/warming composite fabric article further comprises a barrier layer positioned at least adjacent to at least one of the first surface and the opposite, second surface of the fabric layer. The barrier layer may be positioned at least adjacent to, and may be attached upon, the first surface or the opposite, second surface of the fabric layer. The barrier layer is hydrophobic porous, e.g., comprising poly tetra fluoro ethylene (PTFE), or the barrier layer is non-porous hydrophilic, e.g., comprising polyurethane. The electric resistance heating/warming element is washable, non-swelling and hydrophobic. The electric resistance heating/warming element is resistant to stiffening and cold crack. The fabric article is a single face raised fabric article, e.g. with the second surface a raised surface, or a double face raised fabric article, with both first and second surfaces raised surfaces.

According to another aspect of the invention, a method of forming an electric resistance heating/warming composite fabric article comprises: providing a fabric layer having a first surface and an opposite, second surface, and mounting an electricity conductive yarn at the first surface of the fabric layer in a predetermined pattern of an electric circuit to form an electric resistance heating/warming element adapted for connection.to a power source, thereby to generate heating/warming.

Preferred embodiments of the method of the invention may include one or more of the following additional features. The method comprises the further step of incorporating the electric resistance heating/warming composite fabric article into articles of apparel, such as jackets, sweaters, hats, gloves, shirts, pants, socks, boots, and shoes, and/or into home furnishings textile articles, such as blankets, throws and seat warmers. The method comprises the further step of connecting the electric resistance heating/warming element to a power source, thereby to generate heating/warming. The electricity conductive yarn forming the electric resistance heating/warming element comprises one or more of: a core of insulating material, an electrical conductive heating element disposed generally about the core, and a sheath material generally surrounding the electrical resistance heating element and the core, and the method may comprise the further step of forming the sheath material by wrapping the electrical conductive heating element and the core with yarn. The method comprises the further step of connecting the electric resistance heating/warming element to a source of electric power, e.g. alternating current or direct current, e.g., in the form of a battery, and generating heat. The battery may be mounted to the fabric article. The method further comprises the steps of: positioning a barrier layer adjacent to or attached upon at least one of the first surface of the fabric layer and the opposite, second surface of the fabric layer.

Objectives of this invention include providing an electric resistance heating/warming composite fabric article that may be stretchable, making it comfortable to wear, flexible, washable, non-swelling and/or hydrophobic. In embodiments of the invention including a barrier layer associated with or attached to the fabric layer, the electric resistance heating/warming composite fabric article may be waterproof, but also vapor permeable, making it particularly suited for use in winter garments.

The details of one or more embodiments of the invention are set forth in the accompanying drawings and the description below. Other features, objects, and advantages of the invention will be apparent from the description and drawings, and from the claims.

Figure 1:
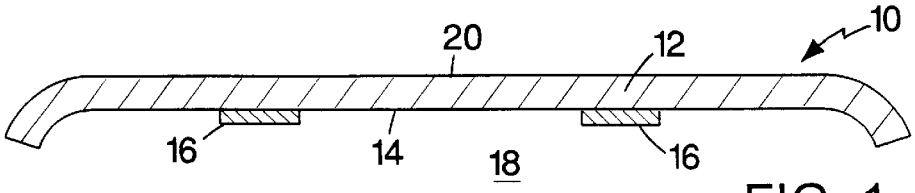
FIGS. 1 and 2 are somewhat diagrammatic side edge views of a first embodiment of an electric resistance heating/ warming composite fabric article constructed in accordance with the invention.
Figure 3A:
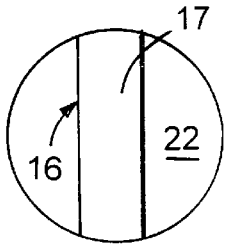
Figure 3:
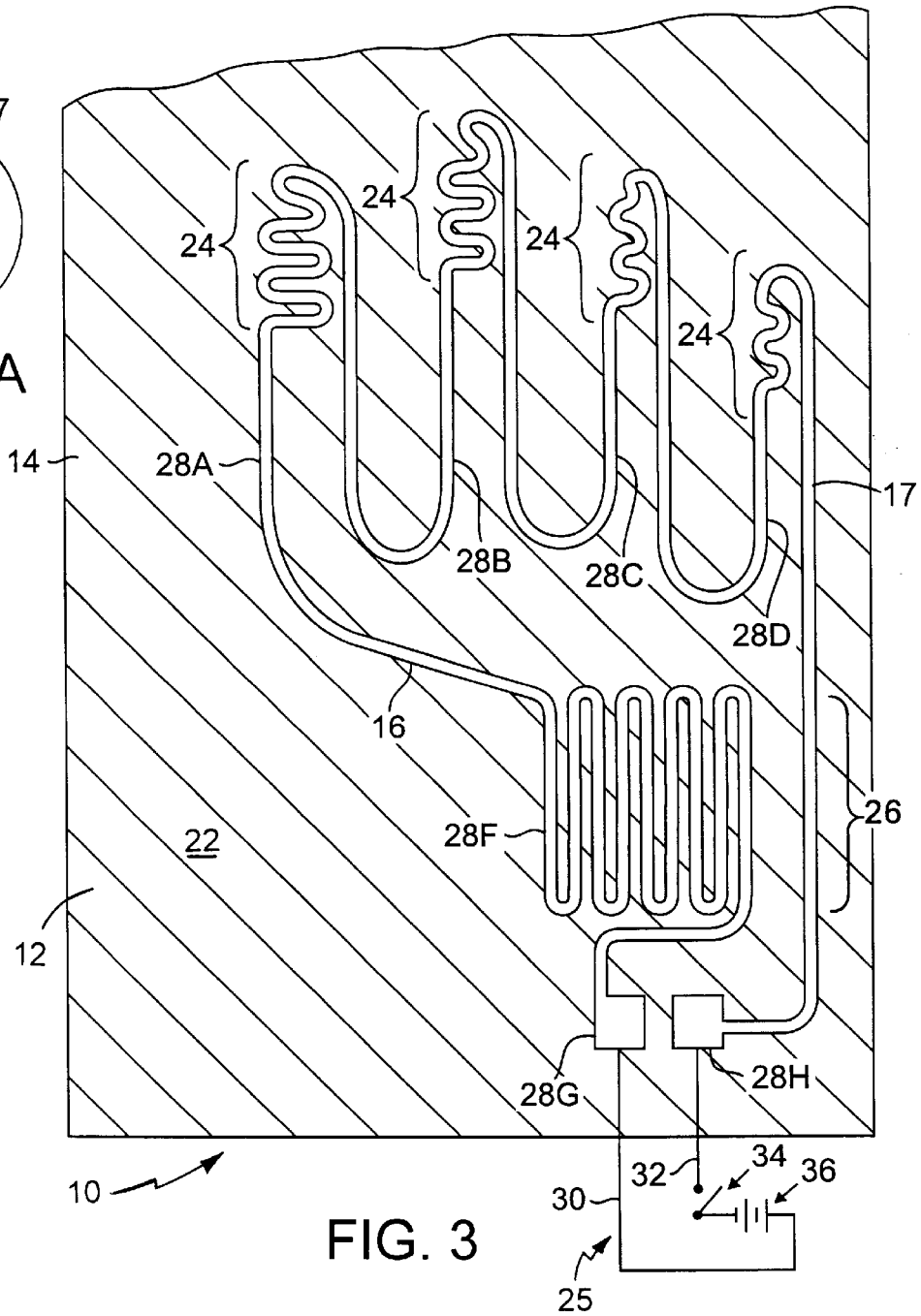
Figure 4:
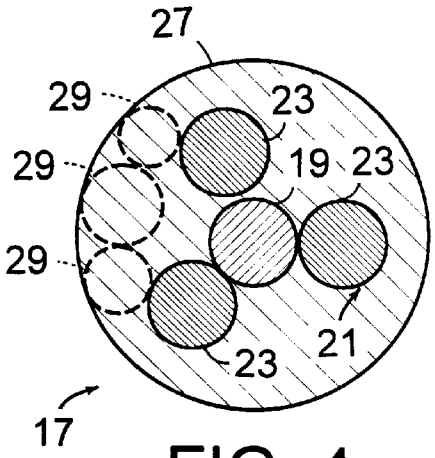
Figure 9:
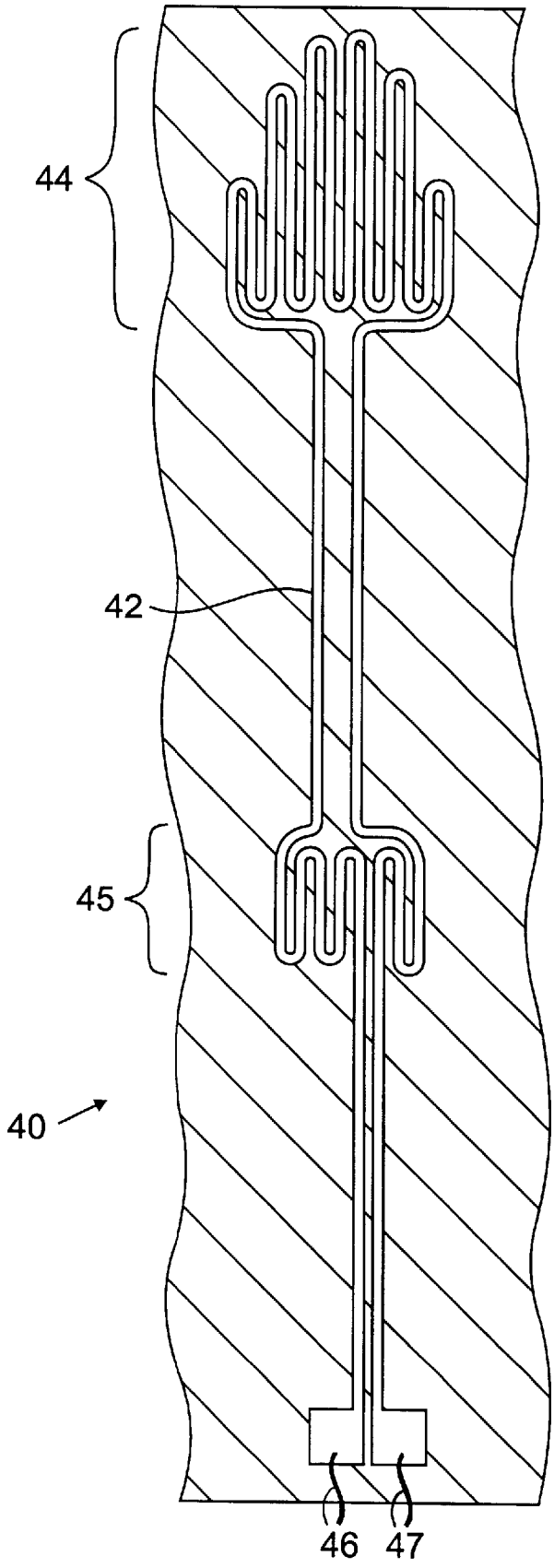
Figure 10:
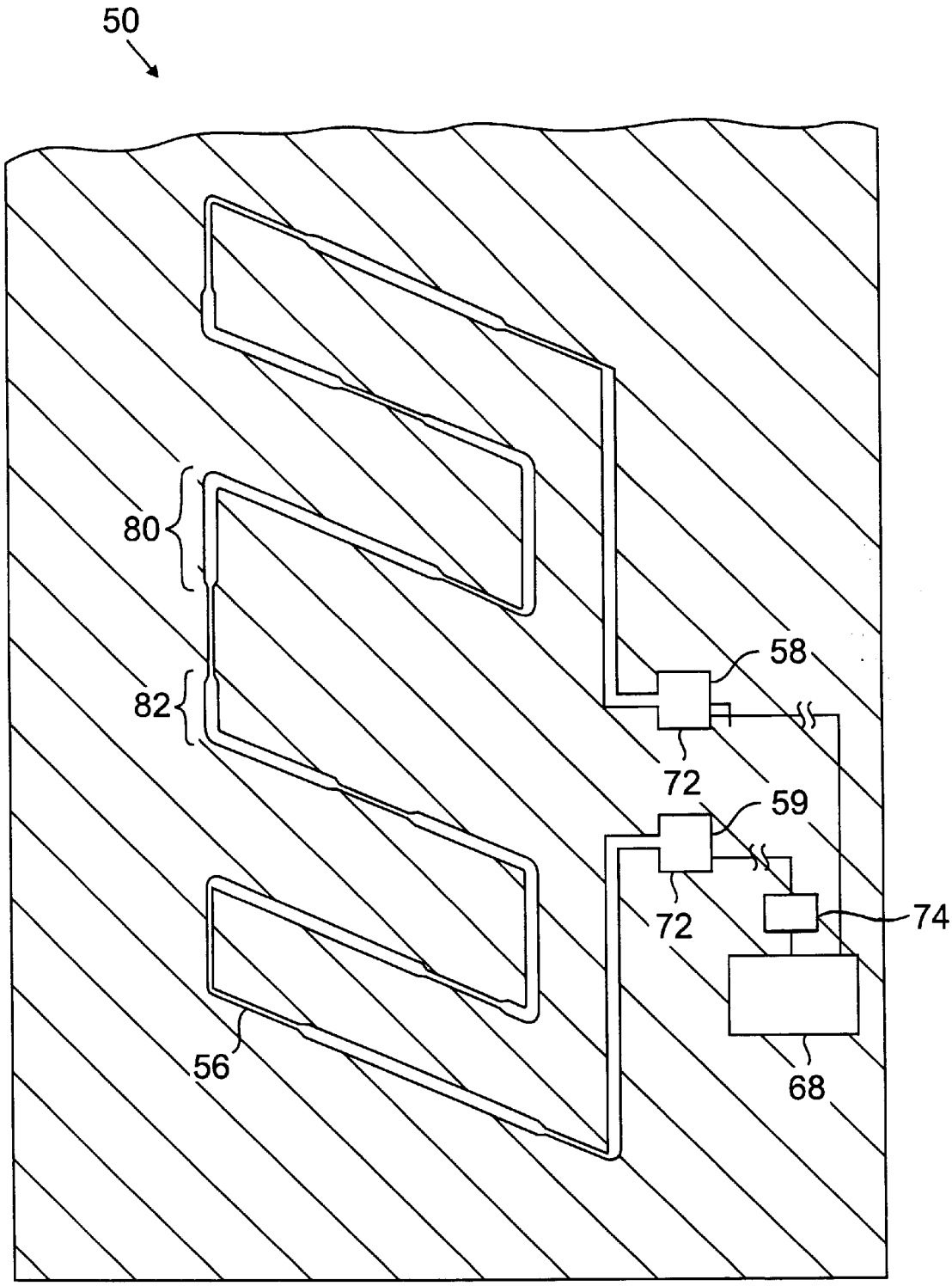
Figure 11:
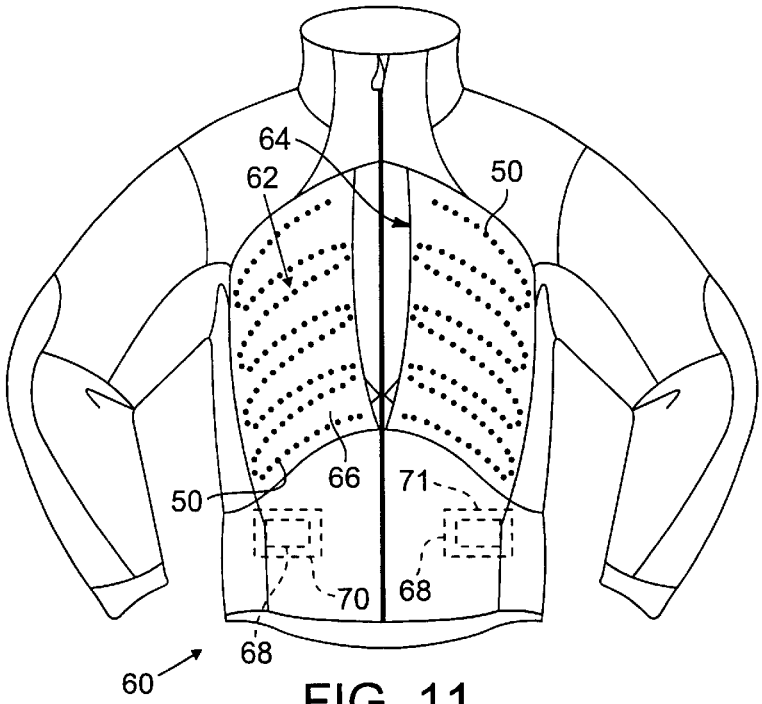

FIG. 3 is a somewhat diagrammatic front plan view of the first surface of the composite fabric article of FIG. 1, with an electric resistance heating/warming element formed thereupon, e.g., for a glove; while FIG. 3A is an enlarged view of the electric resistance heating/warming element showing the conductive yam formed in embroidery stitching or sewing;

FIG. 4 is a somewhat diagrammatic end section view of a preferred embodiment of a conductive yam for an electric resistance heating/warming fabric article of the invention, while FIGS. 5, 6, 7 and 8 are similar views of alternative embodiments of conductive yarns for electric resistance heating/warming fabric articles of the invention;

FIGS. 9 and 10 are somewhat diagrammatic front plan views of the first surfaces of composite fabric articles of FIG. 1, with electric resistance heating/warming elements formed thereupon, e.g., for an article of footwear (FIG. 9), and for a garment such as a shirt or jacket (FIG. 10); and FIG. 11 is a somewhat diagrammatic front view of a garment, i.e., a jacket, incorporating the electric resistance heating/warming composite fabric article of FIG. 10.

Figure 13:
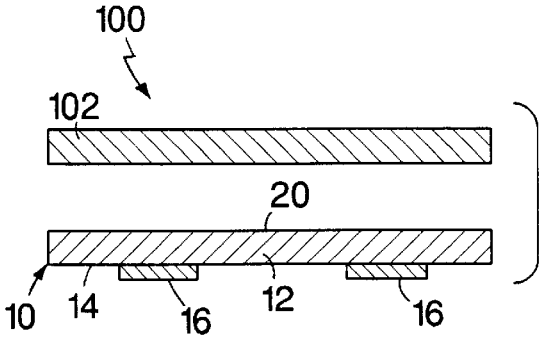
Figure 14:
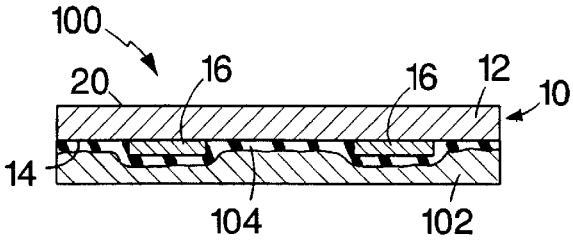
Figure 15:
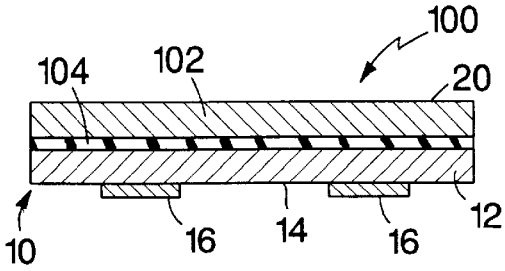

FIGS. 12, 13, 14 and 15 are somewhat diagrammatic side edge views of another embodiment of an electric resistance heating/warming composite fabric article constructed in accordance with the invention and including a barrier layer associated with the first surface of the fabric layer (FIG. 12) or associated with the opposite, second surface of the fabric layer (FIG. 13), or, alternatively, with a barrier layer attached upon the first surface of the fabric layer (FIG. 14)or attached upon the opposite, second surface of the fabric layer (FIG. 15).

Figure 16:
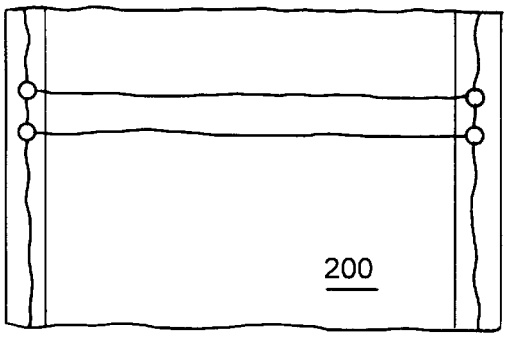

FIG. 16 is a somewhat diagrammatic plan view of an electric resistance heating/warming composite fabric article of apparel (a glove) of the invention, with a parallel circuit of conductive yarns of different resistance.

Figure 17:
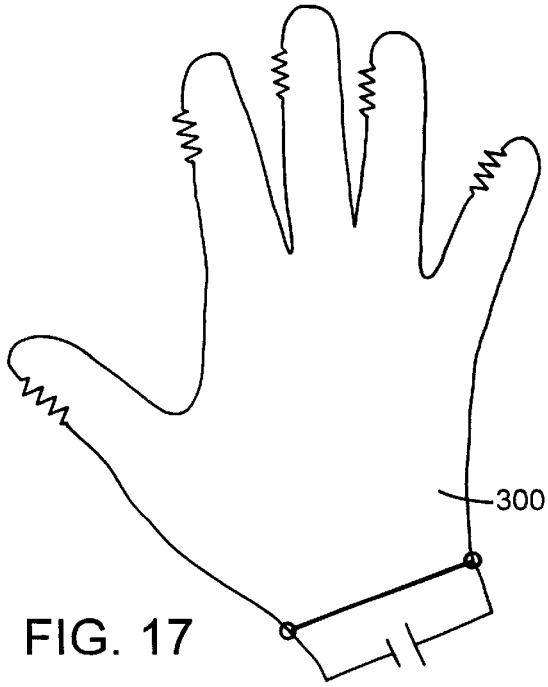

FIG. 17 is a somewhat diagrammatic plan view of a home textile electric resistance heating/warming composite fabric article of the invention, with conductive yams connected in parallel to conductive buses.

Like reference symbols in the various drawings indicate like elements.

DETAILED DESCRIPTION

Figure 2:
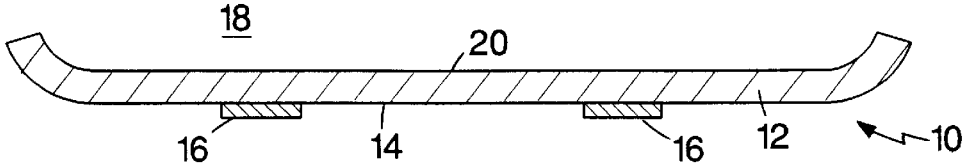
Figure 12:
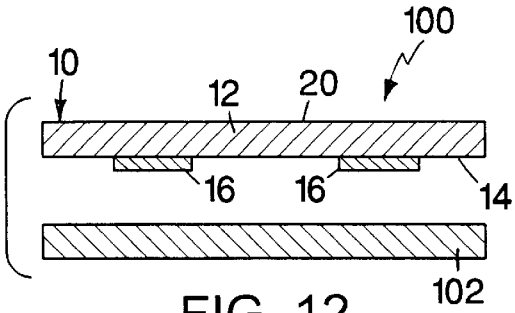

Referring first to FIGS. 1 and 2, in a first embodiment, an electric resistance heating/warming composite fabric article 10 constructed in accordance with the invention includes a fabric layer 12 and an electric resistance heating/warming element 16 formed upon a first surface 14 of the fabric layer 12, e.g., the first surface 14 being an inner surface of the fabric layer 12, relative to the region 18 to be heated/warmed (FIG. 1), or the first surface 14 being an opposite, outer surface of the fabric layer, relative to the region 18 to be heated/warmed (FIG. 2).

In preferred embodiments, the fabric layer 12 is made in any well known manner, e.g. the fabric layer 12 may be a knitted material, e.g., a plaited circular knitted or reverse plaited circular knitted material, or other circular knitted material (such as double knitted, single jersey knitted, two-end fleece knitted, three-end fleece knitted, terry knitted or double loop knitted material), or warp knitted or other weft knitted material, or a woven or non-woven material. In applications of the fabric article 10 having multiple layers, with the fabric layer 12 positioned outwardly, away from the wearer's skin, the material of the fabric layer is preferably hydrophobic, in order to resist penetration of liquids. In other applications of the fabric article 10 having multiple layers, with the fabric layer 12 positioned inwardly, toward the wearer's skin, the material of the fabric layer is preferably naturally hydrophilic, chemically rendered hydrophilic, or hydrophobic, in order to enhance removal and transport of perspiration away from the skin. In a preferred embodiment, the first surface 14 of fabric layer 12, to which the electrical resistance heating/warming element 16 is attached, is flat. The opposite, second surface 20 of fabric layer 12 may be flat or raised, e.g. by brushing, sanding or napping, and/or may be otherwise provided with decorative and functional features and finishes, e.g. as well known in the art. In another embodiment, the electric resistance heating/warming element 16 is incorporated in a double face, raised surface fabric. In both embodiments of the invention, the raised surface fabric, whether single face or double face, provides the advantage of insulating the conductive yarn so that more of the generated heat is available for warming the wearer. Also, the fibers of the raised surface fabric serve to isolate the conductive yam from itself, thereby to reduce the possibility of short circuit.

Referring also to FIG. 3, electric resistance heating/warming element 16 is disposed upon the first surface 14 of fabric layer 12. The electric resistance heating/warming element 16 is preferably formed of a conductive yam 17 having sufficient electrical resistivity when fastened upon the surface of the fabric layer, e.g. in embroidery stitching or sewing (FIG. 3A), to generate a level of heat/warmth suitable for its intended purpose. For example, electrical resistivity of the conductive yarn in the range of 0.1 ohm/m to 500 ohm/m is considered suitable for use in most applications. However, conductive yams performing outside this range can be employed, where required or desired.

Referring to FIG. 4, in a preferred embodiment, the conductive yarn 17 forming the electrical resistance heating element 16 consists of a core 19 of insulating material, e.g. a polyester yarn, about which extends an electrical conductive element 21, e.g. three filaments 23 of stainless steel wire (e.g. 316L stainless steel) wrapped helically about the core 19, and an outer covering 27 of insulating material, e.g. polyester yarns 29 (only a few of which are suggested in the drawings) helically wrapped about the core 19 and the filaments 23 of the electrical conductive element 21. The conductive yarn 17 is available, e.g., from Bekaert Fibre Technologies, Bekaert Corporation, of Marietta, Ga., as yam series VN14.

Figure 7:
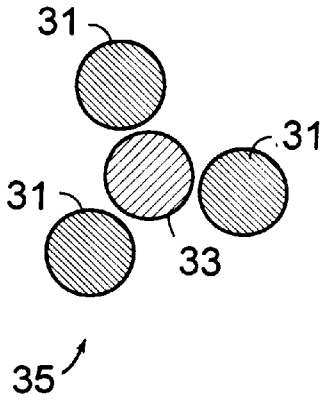
Figure 5:
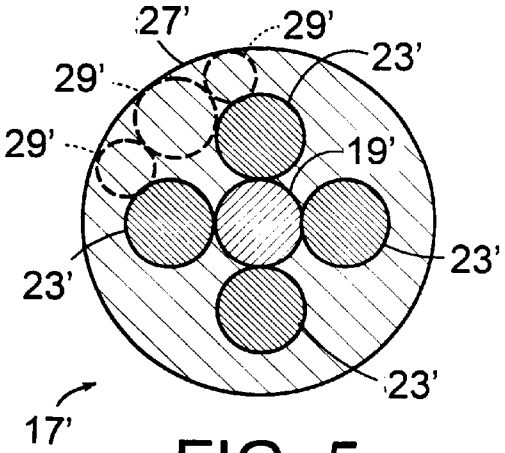
Figure 8:
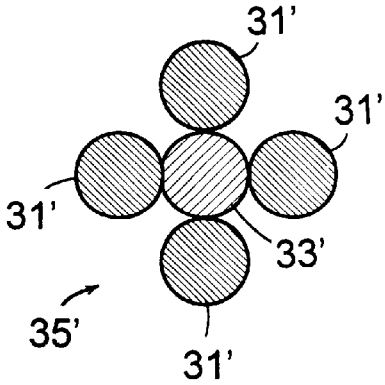
Figure 6:
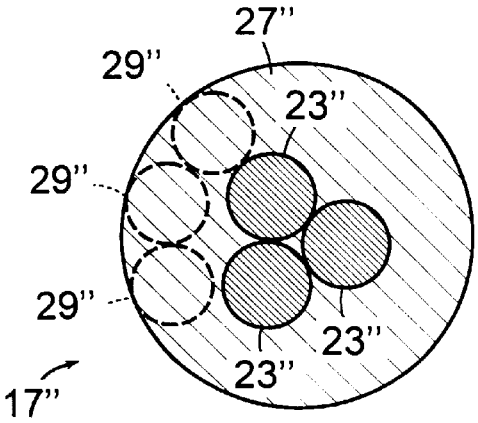

The number of conductive filaments in the conductive yarn, and where the filaments are located, are dependent, e.g., on the end use requirements. For example, in alternative configurations, in FIG. 5, conductive yam 17' has four filaments 23' wrapped about core 19' with an outer covering 27' of polyester yarns 29'; in FIG. 6, conductive yam 17" has three filaments 23" wrapped by outer covering 27" of polyester yams 29", without a core. Referring to FIGS. 7 and 8, in other embodiments, conductive yarns 35, 35', respectively, are formed without an outer covering about the filaments 31, 31', respectively, wrapped about core 33, 33', respectively, the fabric layer 12 instead serving to insulate the conductive yams in the electric resistance heating/warming fabric article. The resistance of the conductive yarn 17 can be selected in the range, e.g., of from about 0.1 ohm/cm to about 500 ohm/cm on the basis of end use requirements of the electric resistance heating/warming fabric article 10. However, conductive yams performing outside this range can also be employed, where required. The core of the conductive yarn and the sheath material of the outer covering over the conductive filaments may be made of synthetic or natural material. The outer covering may also have the form of a sleeve, e.g. a dip-coated or extruded sleeve. Conductive yams of different constructions suitable for use according to this invention can also be obtained from Bekaert Fibre Technologies. Preferably, the conductive yarn 17 is applied upon the fabric layer first surface 14 in a predetermined pattern of embroidery stitching or sewing, to form an electric resistance heating/warming element 16 which is very flexible and can be bent and/or stretched without adversely affecting the electrical circuit. The fabric article 10, including the electric resistance heating/warming element 16 thereupon, is washable, and the heating/warming element 16 is non-swelling and hydrophobic. Preferably, the conductive yarn 17 is constructed to be resistant to stiffening and cracking upon exposure to low temperatures, e.g. such as those experienced in northern climes.

The predetermined embroidery stitching or sewing pattern of the electric resistance heating/warming element 16 may be custom designed for the particular use and purpose of the garment for which the composite fabric article 10 of the invention is to be used. For example, the pattern of the heating/warming element 16 of the composite fabric article 10 of FIG. 3 is designed for use in making a glove. For this purpose, the conductive yarn 17 of the electric heating/warming element 16 is embroidery stitched or sewn upon the first surface 14 of the fabric layer 12 to form a pattern having four elongated branches 28A, 28B, 28C, 28D (corresponding to fingers of a glove) and one or more labyrinth or zigzag sections 28F (corresponding to the palm or back of the body of a glove). The heating/warming element 16 is formed as a continuous circuit, terminating at 28G, 28H with free end portions of the conductive yarn 17 forming contacts 30, 32, respectively, which preferably are disposed adjacent to each other in a region convenient for connection to a source of power, e.g. for a glove, as shown, in a region to form the wrist of the glove. Still referring to FIG. 3, the electrical resistance heating/warming element 16 is connected by the free end/contact portions 30, 32 of the conductive yarn 17 in a circuit 25 including a switch 34 and a power supply, e.g., a battery pack 36. When switch 34 is closed, the heating/warming element 16 is activated to generate heat/warmth. (If necessary, the electrical conductive elements in the free end/contact portions 30, 32 of the conductive yarn 17 may be exposed, e.g., the polyester covering yarn may be removed with solvent or localized heat, e.g. by laser, or the covering yarn may be manually unraveled, thus to facilitate accessibility to the electrical conductive portions of the yarn.)

The pattern features of the electric resistance heating/warming element 16 shown in FIG. 3 are sized and shaped to conform to the regions of the resulting fabric article, i.e., the glove, so that the composite fabric can readily be cut to form one side of a glove. Patterns for use in other types and sizes of garments and fabric articles, e.g. such as socks, sweaters, jackets, shirts, pants, hats, gloves, footwear (e.g. shoes and boots) and so on, can be generated in a similar manner.

For example, referring to FIG. 9, a composite fabric article 40 of the invention has a heating/warming element 42 sized and shaped to conform to the regions of the selected resulting fabric article, i.e., in this embodiment, a boot, to be heated/warmed so that the composite fabric can readily be cut to be formed and/or incorporated into a boot liner. In particular, the heating/warming element 42 has heating/warming regions 44, 45 of concentrated zigzag embroidery stitching upon the first surface 14 of the fabric layer 12, the regions 44, 45 corresponding to the toe/ball and heel surface regions, respectively, of a wearer's foot. The heating/warming element 42, which is formed as a continuous circuit, terminates with free end/contact portions 46, 47 of the conductive yarn, which are disposed adjacent to each other in a region convenient for connection to a source of power, e.g., as shown, in a region to extend into or above the ankle collar of the boot.

Referring finally to FIG. 10, a composite fabric article 50 of the invention has a heating/warming element 56 sized and shaped to conform to the regions of the selected resulting fabric article, i.e., in this embodiment, the opposite chest surfaces of a garment such as a shirt or a jacket 60 (FIG. 11), to be heated/warmed. The heating/warming element 56, which is formed as a continuous circuit, terminates at conductive yarn free end/contact portions 58, 59, respectively, which are disposed adjacent to each other in a region convenient for connection to a source of power, as discussed below.

Referring also to FIG. 11, a pair of fabric articles 50 are shown incorporated into jacket 60. A battery pack 68 for powering each of the heating/warming composite fabric articles 50 is contained in the associated zippered pockets 70, 71. The battery pack 68, e.g. as available from Polaroid Corporation, of Cambridge, Mass., is preferably removably connected to the free end/contact portions 58, 59 of heating/warming element 56, e.g. by releasable fastening elements 72, e.g. clips, snaps or other secure but releasable fastening elements. (The fastening elements may provide the electrical connection of the battery pack to the circuit, or, alternatively, may maintain the battery pack in position for contact of the battery pack with separate connectors.) This arrangement permits the battery pack 68 to be removed, e.g., whenever the fabric article 50 is to be washed, or for replacement. The heating/warming circuit 56 may also include an oscillator chip 74 or other timing or cycling device for cycling application of electrical power from the battery pack 68 to the heating/warming element 56, e.g., to extend battery pack life. For example, a timing cycle of three minutes "on" followed by one minute "off" is considered suitable for an electric heating/warming composite fabric article 50 incorporated as a chest panel of the heating/warm jacket 60 suited for outdoors use.

Referring now to FIGS. 12, 13, 14, and 15, the electric resistance heating/warming composite fabric article 10 of the invention may also be combined with a barrier layer 102 to form a stretchable, windproof, water-resistant, and vapor permeable electric resistance heating/warming composite fabric article 100 constructed in accordance with this invention. The barrier 102 is at least adjacent to a surface of the fabric layer 12. For example, the barrier layer 102 may be associated a surface of the fabric layer 12 (FIGS. 12 and 13), or the barrier layer 102 may be attached upon a surface of the fabric layer 12, e.g., by lamination and/or with an adhesive 104 (FIGS. 14 and 15). The barrier layer 102 may be associated with the surface of the fabric layer 12 having the embroidery stitch or sewn circuit 16 formed thereupon, i.e. the first surface 14 (FIG. 12), or the barrier layer 102 may be attached upon the first surface 14, e.g., in FIG. 14, the barrier layer 102 is attached to the first surface 14 of the fabric layer 12, e.g. by lamination and/or with adhesive 104, overlying the circuit 16. Alternatively, the barrier layer 102 may be associated with or attached upon the second surface 20 of the fabric layer 12, opposite to the first surface 14 upon which the circuit 16 is formed by embroidery stitching (FIG. 13 and FIG. 15, respectively).

Preferably, the barrier layer 102 is formed of a vapor permeable membrane which is nonporous hydrophilic (e.g., polyurethane) or micro-porous hydrophobic (e.g., poly tetra fluoro ethylene (PTFE)) or a combination of both, e.g. in layers, as appropriate to the nature of the intended use, or as otherwise desired. In many embodiments, it is also preferred that the material of the barrier layer 102 be soft and stretchable. The barrier layer is constructed and/or formulated to resist air and water droplets from passing through the composite fabric article 100 while being permeable to water vapor. In applications where it is desired that the fabric article 100 is stretchable, the fabric layer 12 may typically be a knitted material, and a preferred material for barrier layer 102 is poly urethane, e.g. as available from UCB Chemical Corp. of Drogenbos, Belgium, either microporous hydrophobic (preferred for use where the barrier layer 102 is directed outward) or nonporous hydrophilic (preferred for use where the barrier layer 102 is directed inward, relative to the region 18 to be heated/warmed). Alternatively, in situations where relatively less stretch is required, e.g. in footwear, the fabric layer 12 may be a warp knitted material, and a preferred material for barrier layer 102 is poly tetra fluoro ethylene (PTFE), e.g., as available from Tetratec, of Feasterville, Pa.

Referring again to FIGS. 14 and 15, the barrier layer 102 is joined to the first surface 14 of fabric layer 12 by adhesive 104, typically applied in spots, lines or other discrete regions, or by attachment, lamination or other suitable manner of combining. A similar composite fabric (but having an additional internal fabric layer) is described in commonly assigned Lumb et al. U.S. Pat. No. 5,364,678, the entire disclosure of which is incorporated herein by reference.

A barrier layer 102 associated with (FIG. 12) or attached, e.g. by lamination or other techniques, upon (FIG. 14) the surface 14 of the fabric layer 12 upon which the embroidery stitched or sewn circuit 16 is formed serves also to protect the circuit against the effects of abrasion that might otherwise deteriorate the quality or continuity of the electrical heating circuit. In this embodiment, the barrier layer 102 may be formed of any suitable, protective material, e.g. a breathable plastic material, as described above, another layer of fabric, or the like.

A pair of fabric articles 100 may be incorporated into garment, e.g. a jacket 60, as shown in FIG. 11, where the outer coverings 62, 64 of the opposite chest surfaces of the jacket may be a shell material selected to provide a barrier layer overlaying the heating/warming composite fabric articles 100 incorporated into the jacket.

The relative amounts of heat/warmth generated by a region of an electrical resistance heating/warming element in a composite heating/warming fabric article of the invention can be controlled, e.g., by varying the effective volume density of the conductive yarn in a predetermined regions, i.e., by varying the size, bulk, thickness, tightness, density, and/or number of stitches, and/or by varying the conductivity/resistivity of the conductive yam 17 forming the electrical resistance heating/warming element 16. For example, referring to FIG. 10, a heating/warming element 56 is formed of a conductive yarn of uniform conductivity applied by embroidery stitching or sewing to form regions 80 and 82 of contrasting width, and, therefore, contrasting effective density. As a result, in region 80 of relatively greater width, there is relatively more conductive yarn and thus relatively more generation of heat/warmth. Similarly, in region 82 of relatively lesser width, there is relatively less conductive yarn and thus relatively less generation of heat/warmth. As a result, a composite heating/warming fabric article 50 of the invention can be designed with a circuit element 56 that delivers relatively greater amounts of heat/warmth to selected regions of the wearer's body.

In other embodiments, this effect may also or instead be achieved by concentrating a relatively greater length of conductive yarn 17, e.g. in a tortuous, zigzag and/or interlocking spiral pattern, in a region of greater heat requirement. For example, referring to FIG. 9, a zigzag circuit pattern is provided in regions 44, 45 corresponding to toe/ball and heel surfaces, respectively, of a composite heating/warming fabric article 40 of the invention, i.e., a boot liner; and also, referring to FIG. 3, in the fingertip regions 24 and hand surface region 26 of a composite heating/warming fabric article 10 of the invention, i.e., a glove.

Alternatively, or in addition, an electric resistance heating/warming element of constant dimension but with regions generating relatively different levels of heat/warmth may be formed by forming circuit regions using yams of inherently different conductivity, e.g. by varying the dimensions or nature of the conductive filaments 23. For example, in regions where relatively more heating is desired, e.g. thumb, fingertips, etc., a segment of yarn having relatively less conductivity (and therefore relatively more generation of heat) may be employed. Conversely, in regions where relatively less heating is desired, e.g. forefingers, etc., a segment of yarn having relatively more conductivity (and therefore relatively less generation of heat) may be employed. These and other methods for adjusting the conductivity of electrical circuit regions may be employed alone, or in any desired combination.

In all cases described above, a fabric layer supports the electric resistance heating/warming layer, whether or not a barrier layer is provided. The fabric layer may be naturally hydrophilic, chemically rendered hydrophilic, or hydrophobic. In some embodiments, a barrier layer is provided at least adjacent to the inner surface of the fabric layer, i.e., attached to the fabric layer (with or without intervening materials) or spaced from attachment to or upon the fabric layer.

According to a presently preferred embodiment of articles and methods of the invention, apparel and home textiles generating heating/warming upon connection of a source of electrical power consist of a base fabric layer that is single face or double face, i.e. raised on one or both surfaces. (The base fabric layer may also be flat on both sides.) A protective and/or barrier layer of film, e.g. a breathable film, preferably hydrophobic porous, like poly tetra fluoro ethylene (PTFE), or non-porous hydrophilic, like polyurethane, or a layer of fabric, is attached, e.g. by lamination, upon a flat surface of the single face or flat base fabric layer. The heating/warming element is formed of a conductive yarn, typically having resistance between about 0.1 ohm/meter and about 500 ohm/meter, attached upon a surface of the base fabric by embroidery stitching or sewing. Alternatively, the conductive yarn may'be laid in a pattern upon the smooth side of a single face or flat fabric and a secured by adhesive, mechanical locking, or by lamination of the protective and/or barrier layer of film, which provides protection for the conductive yarns, e.g. from abrasion, and/or resists through passage of air, for improved heating/warming performance. The conductive yarn has an advantage, e.g., over a printed circuit, in that it resists variation in conductivity and heating/warming performance, even after repeated folding of the base fabric layer.

For articles of apparel, such as in gloves 10, 50, shown in FIGS. 3 and 10, respectively, and for smaller heating/ warming units, the conductive yarns may be arranged in electrical series. Referring now to FIG. 16, in an article of apparel, i.e. a glove 300, the electric resistance heating/warming element 302 is arranged in a parallel circuit with conductive yarns 304, 306 of the same or different resistances. For example, referring to the drawing, the first conductive yarn 304 of a first resistivity ($R_1$) extends upon the surface 308 of a fabric article 300 to be heated/warmed, and the second conductive yarn 306 is disposed in a parallel to the first conductive yarn 304 and has a second resistivity ($R_2$), where $R_2$ may be the same as $R_1$, or $R_2$ may be different from, e.g. much less than, $R_1$. The respective ends 310, 312 of the heating/warming element 302 are connected to a power source, e.g. a battery 314 mounted to the article of apparel.

For other applications, such as home textile fabrics, the conductive yarns may be arranged in parallel (either symmetrically or asymmetrically spaced). For example, referring to FIG. 17, in a home textile heating/warming fabric 400 of the invention, conductive yarns 402, 404 are connected in parallel to conductive buses 406, 408 of very low resistivity, e.g. metal wires 410, 412, extending between and connected to the conductive yarns by conductive adhesive regions 414, 416.

A number of embodiments of the invention have been described. Nevertheless, it will be understood that various modifications may be made without departing from the spirit and scope of the invention. For example, additional fabric layers may be added to enhance various esthetics and functional characteristics of the electric heating/warming composite fabric article. Accordingly, other embodiments are within the scope of the following claims.

What is claimed is:

1. A method of forming an electric resistance heating/warming composite fabric article, comprising:

providing a fabric layer having a first surface of raised fibers of electrically-insulating material and an opposite, second surface, mounting an electricity conductive yarn among, the raised fibers of the first surface of the fabric layer in a manner to cause the raised fibers to electrically isolate adjacent segments of the electrically conductive yarn disposed in a predetermined pattern of an electric circuit to form an electric resistance heating/warming element adapted for connection to a power source, thereby to generate heating/warming, connecting adjacent segments of the electrically conductive yarn in the electrical circuit in parallel, with a first segment of the conductive yarn having a first resistance and a second segment of the conductive yarn having a second resistance, the first resistance being different from the second resistance, and positioning a barrier layer resistant to passage of air and water droplets and permeable to passage of water vapor at least adjacent to at least one of the first surface of the fabric layer and the opposite, second surface of the fabric layer.

2. The method of claim 1, comprising the further step of incorporating the electric resistance heating/warming composite fabric article into articles of apparel.

3. The method of claim 2, wherein the articles of apparel include at least one of the following: jackets, sweaters, hats, gloves, shirts, pants, socks, boots, and shoes.

4. The method of claim 1, comprising the further step of incorporating the electric resistance heating/warming composite fabric article into home furnishings textile articles.

5. The method of claim 1, wherein the home furnishings textile articles include at least one of the following: blankets, throws and seat warmers.

6. The method of claim 1, comprising the further step of connecting the electric resistance heating/warming element to a power source, thereby to generate heating/warming.

7. The method of claim 1, wherein the electricity conductive yarn forming the electric resistance heating/warming element comprises a core of insulating material, an electrical conductive heating element disposed generally about the core, and a sheath material generally surrounding the electrical-resistance heating element and the core, and said method comprises the further step of forming the sheath material by wrapping the electrical conductive heating element and the core with yarn.

8. The method of claim 1, comprising the further step of connecting the electric resistance heating/warming element to a source of electric power and generating heat.

9. The method of claim 8, comprising the further step of connecting the electric resistance heating/warming element to a source of electric power comprising alternating current and generating heat.

10. The method of claim 8, comprising the further step of connecting the electric resistance heating/warming element to a source of electric power comprising direct current and generating heat.

11. The method of claim 10, comprising the further step of connecting the electric resistance heating/warming element to a source of electric power comprising direct current in the form of a battery and generating heat.

12. The method of claim 11, comprising the further step of connecting the electric resistance heating/warming element to a source of electric power comprising direct current in the form of a battery mounted to the fabric article and generating heat.

13. The method of claim 1, comprising the further step of positioning the barrier layer in attachment upon the first surface of the fabric layer.

14. The method of claim 1, wherein the opposite, second surface of the fabric layer is of raised fibers of electrically-insulating material.

15. The method of claim 1, wherein the mounting step comprises stitching the electrically conductive yam upon the first surface.

16. The method of claim 1 wherein the mounting step comprises sewing the electrically conductive yam upon the first surface.

17. The method of claim 1 wherein the mounting step comprises adhering the electrically conductive yam to the first surface.

18. A method of forming an electric resistance heating/warming composite fabric article, comprising:

providing a fabric layer having a first surface of raised fibers of electrically-insulating material and an opposite, second surface, mounting an electricity conductive yarn among the raised fibers of the first surface of the fabric layer in a manner to cause the raised fibers to electrically isolate adjacent segments of the electrically conductive yarn disposed in a predetermined pattern of an electric circuit to form an electric resistance heating/warming element adapted for connection to a power source, thereby to generate heating/warming, and connecting adjacent segments of the electrically conductive yam in the electrical circuit in parallel, with a first segment of the conductive yam having a first resistance and a second segment of the conductive yarn having a second resistance, the first resistance being different from the second resistance.

19. The method of claim 18, comprising the further step of incorporating the electric resistance heating/warming composite fabric article into articles of apparel.

20. The method of claim 19, wherein the articles of apparel include at least one of the following: jackets, sweaters, hats, gloves, shirts, pants, socks, boots, and shoes.

21. The method of claim 18, comprising the further step of incorporating the electric resistance heating/warming composite fabric article into home furnishings textile articles.

22. The method of claim 18, wherein the home furnishings textile articles include at least one of the following: blankets, throws and seat warmers.

23. The method of claim 18, comprising the further step of connecting the electric resistance heating/warming element to a power source, thereby to generate heating/warming.

24. The method of claim 18, wherein the electricity conductive forming the electric resistance heating/warming element comprises a core of insulating material, an electrical conductive heating element disposed generally about the core, and a sheath material generally surrounding the electrical resistance heating element and the core, and said method comprises the further step of forming the sheath material by wrapping the electrical conductive heating element and the core with yarn.

25. The method of claim 18, comprising the further step of connecting the electric resistance heating/warming element to a source of electric power and generating heat.

26. The method of claim 25, comprising the further step of connecting the electric resistance heating/warming element to a source of electric power comprising alternating current and generating heat.

27. The method of claim 25, comprising the further step of connecting the electric resistance heating/warming element to a source of electric power comprising direct current and generating heat.

28. The method of claim 27, comprising the further step of connecting the electric resistance heating/warming element to a source of electric power comprising direct current in the form of a battery and generating heat.

29. The method of claim 28, comprising the further step of connecting the electric resistance heating/warming element to a source of electric power comprising direct current in the form of a battery mounted to the fabric article and generating heat.

30. The method of forming an electric resistance heating/warming composite fabric article of claim 18, further comprising positioning a barrier layer resistant to passage of air and water droplets and permeable to passage of water vapor at least adjacent to at least one of the first surface of the fabric layer and the opposite, second surface of the fabric layer.

31. The method of claim 30, comprising the further step of positioning the barrier layer in attachment upon the first surface of the fabric layer.

32. The method of claim 18, wherein the opposite, second surface of the fabric layer is of raised fibers of electrically-insulating material.

33. The method of claim 18 wherein the mounting step comprises mechanically securing the electrically conductive yam to the first surface.

34. The method of claim 18, wherein the mounting step comprises stitching the electrically conductive yam upon the first surface.

35. The method of claim 18 wherein the mounting step comprises sewing the electrically conductive yam upon the first surface.

36. The method of claim 18 wherein the mounting step comprises adhering the electrically conductive yam to the first surface.

37. The method of claim 18 wherein the mounting step comprises mechanically securing the electrically conductive yarn to the first surface.

* * * * *

UNITED STATES PATENT AND TRADEMARK OFFICE

CERTIFICATE OF CORRECTION

PATENT NO. : 6,548,789 B1
DATED : April 15, 2003
INVENTOR(S) : Vikram Sharma and Moshe Rock It is certified that error appears in the above-identified patent and that said Letters Patent is hereby corrected as shown below:

Column 9,
Line 39, after "among" delete ",".

Column 10,
Lines 46, 49, 65 and 66, replace "yam" with -- yarn --.

Column 12,
Lines 25, 27, 30 and 33, replace "yam" with -- yarn --.

Signed and Sealed this

Fourteenth Day of October, 2003

JAMES E. ROGAN
*Director of the United States Patent and Trademark Office*